US007418754B2

(12) United States Patent
Kim et al.

(10) Patent No.: US 7,418,754 B2
(45) **Date of Patent: *Sep. 2, 2008**

(54) APPARATUS FOR CONTROLLING DOOR OF DRUM TYPE WASHING MACHINE AND METHOD THEREOF

(75) Inventors: Gon Kim, Jinhae-si (KR); Yu Beom Kang, Changwon-si (KR); Sang Man Je, Koje-si (KR)

(73) Assignee: LG Electronics Inc., Seoul (KR)

( * ) Notice: Subject to any disclaimer, the term of this patent is extended or adjusted under 35 U.S.C. 154(b) by 531 days.

This patent is subject to a terminal disclaimer.

(21) Appl. No.: 10/720,393

(22) Filed: Nov. 25, 2003

(65) Prior Publication Data

US 2004/0107509 A1 Jun. 10, 2004

(30) Foreign Application Priority Data

Nov. 28, 2002 (KR) ..... 10-2002-0075037

(51) Int. Cl.
*D06F 35/00* (2006.01)

(52) U.S. Cl. ..... 8/158; 8/159; 68/12.21; 68/12.26; 68/75

(58) Field of Classification Search ..... 8/158, 8/152, 258, 159; 134/192; 68/12.21, 12.26, 68/75

See application file for complete search history.

(56) References Cited

U.S. PATENT DOCUMENTS

| | | | | |
|---|---|---|---|---|
| 5,802,884 | A * | 9/1998 | Cavalli | 68/18 C |
| 6,582,276 | B1 * | 6/2003 | Bao | 446/479 |
| 6,626,013 | B2 * | 9/2003 | Ohta et al. | 68/12.27 |
| 7,111,478 | B2 * | 9/2006 | Fukui et al. | 68/12.24 |
| 2005/0223506 | A1 * | 10/2005 | Kwen et al. | 8/159 |

* cited by examiner

*Primary Examiner*—Michael Barr
*Assistant Examiner*—Rita R Patel
(74) *Attorney, Agent, or Firm*—Ked & Associates, LLP

(57) ABSTRACT

A system for controlling a door of a drum type washing machine is provided. This system allows the door to be opened only if there is no water in the washing tub, or if the water level in the tub is very low, so as to prevent water in the tub from cascading out of the washing machine when the door is opened. A water level in the washing tub is sensed, and the sensed water level is compared to a reference water level. The door is locked or unlocked based on the comparison of the sensed water level and the reference water level.

18 Claims, 3 Drawing Sheets

APPARATUS FOR CONTROLLING DOOR OF DRUM TYPE WASHING MACHINE AND METHOD THEREOF

This application claims the benefit of Korean Application No. P 2002-75037 filed on Nov. 28, 2002, which is hereby incorporated by reference.

BACKGROUND OF THE INVENTION

1. Field of the Invention

The present invention relates to a drum type washing machine, and more particularly, to an apparatus for controlling a door of a drum type washing machine and method thereof.

2. Discussion of the Related Art

Generally, a drum type washing machine according to a related art, as shown in FIG. 1, includes a washing tub 11 for washing a laundry inside, a dewatering tub (not shown in the drawing) outside the washing tub 11, a case 10 protecting the washing tub 11 and to hold various driving equipments (not shown in the drawing) for driving the washing tub 11, a door 20 provided on a front side of the case 10 for putting the laundry in/out of the washing tub 11, a detergent box 12 and a control unit 13 for an operation and control of the washing machine provided in an upper front part of the case 10.

The door 20 consists of a door body 21 hinge-coupled to an opening 15 of the case 10 to open/close and a window 22 installed at a central part of the door body 21 and formed of a transparent material enabling an inside of the washing tub 11 to be seen through the closed door body 21.

The drum type washing machine performs washing by rotating the washing tub 11, which holds the water, detergent, and laundry inside and has a plurality of protrusions provided inside, at low speed centering on a horizontal axis using shock energy generated from lifting the laundry to fall by the protrusions. Hence, compared to a pulsator type washing machine performing washing using a frictional force between the laundry and the water rotated by a pulsator, the drum type washing machine almost prevents entanglement and damage of the laundry as well as reduces its water consumption.

Yet, the door 20 of the drum type washing machine is installed on the front side of the case. If the door 20 is opened before the washing machine operates, water in the washing tub 11 may flood out. In order to prevent such a problem, a door lock assembly 30 and 30' determining open/close of the door 20 is installed at contact areas of the door 20 and the case 10. When the washing machine is not in use, the door 20 is always locked to close the door 20.

The door lock function is automatically performed. In case that power is cut off, the door is definitely performed so that the door is not opened. Thus, in order to control the locking/unlocking of the door, a door control equipment is needed.

In a door control equipment of a washing machine according to a related art, a user firstly checks whether power is on or off. If the power is off, the door lock function is maintained. If the power is on, the door lock function is released to let the door open. Hence, when the power is off, it is unable to open the door. But, the door can be opened only if the power is on.

However, the related art door control equipment of the washing machine allows the door to be opened when the power is on even if the washing tub is filled with the water. Hence, the water in the washing tub cascades out to cause inconvenience to the user.

SUMMARY OF THE INVENTION

Accordingly, the present invention is directed to an apparatus for controlling a door of a drum type washing machine and method thereof that substantially obviates one or more of the problems due to limitations and disadvantages of the related art.

An object of the present invention, which has been devised to solve the foregoing problem, lies in providing an apparatus for controlling a door of a drum type washing machine and method thereof, by which water is prevented from cascading out of the washing machine when a door is opened.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided an apparatus for controlling a door of a drum type washing machine including a water level sensor sensing a water level of water held in a washing tub, a door lock locking/unlocking the door, a control unit judging whether to open or close the door according to the water level in the washing tub and controlling the door lock according to the judgment, and a display unit displaying whether to open or close the door to a user.

In this case, the control unit compares the water level in the washing tub to a reference to judge whether to open the door. If the water level in the washing tub is higher than the reference, the control unit judges that it is impossible to open the door. If the water level in the washing tub is lower than the reference, the control unit judges that the door can be opened.

In another aspect of the present invention, there is provided a method of controlling a door of a drum type washing machine including the steps of sensing a water level in a washing tub, comparing the sensed water level to a reference, and locking or unlocking the door according to a result of the comparing step.

Moreover, the method further includes the step of checking whether power is applied to the washing machine. If the power is not applied, the door is locked. If the power is applied, it is checked whether the washing tub is rotating. If the washing tub is rotating, the door is locked. And, if the washing tub is not rotating, the water level in the washing tub is sensed.

In another aspect of the present invention, there is provided an apparatus for controlling a door of a drum type washing machine including a motor sensor sensing a motor for driving a washing tub, a water level sensor sensing a water level of water held in the washing tub, a door lock locking/unlocking the door, a control unit controlling the door lock to lock/unlock the door according to the water level in the washing tub in case that a user's command for opening the door is inputted to the washing machine, and a display unit displaying a lock/unlock status of the door.

In this case, the control unit compares the water level in the washing tub to a reference to determine whether to open the door. If the water level in the washing tub is higher than the reference, the control unit locks the door. And, if the water level in the washing tub is lower than the reference, the control unit unlocks the door.

In another aspect of the present invention, there is provided a method of controlling a door of a drum type washing machine including the steps of receiving a user's command for opening the door, checking whether a power is applied to the washing machine, unlocking the door if the power is not applied or checking whether water exists in a washing tub if the power is applied, unlocking the door if the water fails to exist in the washing tub or sensing a water level in the washing tub if the water exists in the washing tub, and locking or unlocking the door according to the sensed water level.

In the step of locking or unlocking the door according to the sensed water level, the door is locked if the sensed water level is higher than the reference or the door is unlocked if the sensed water level is lower than the reference.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
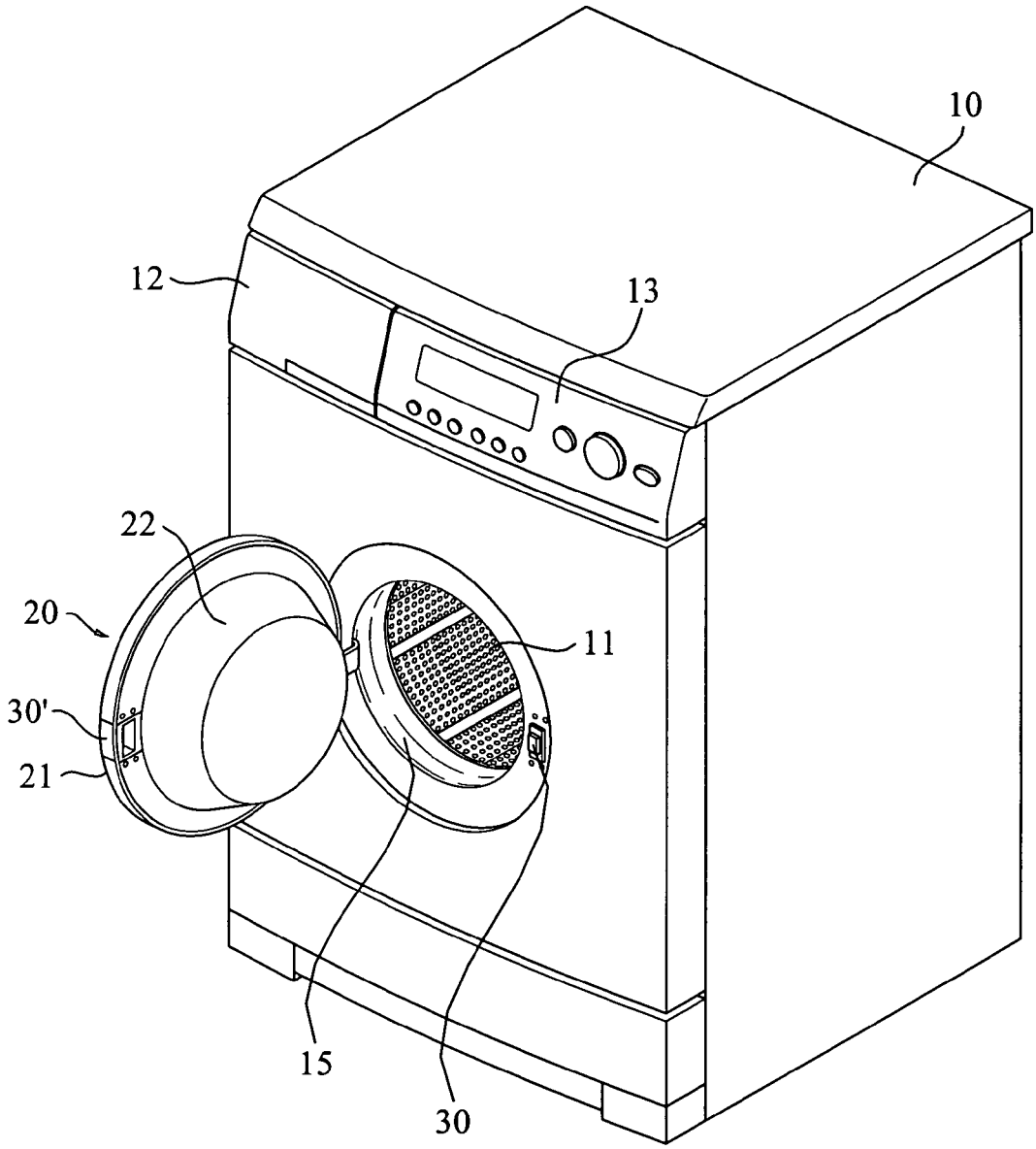
FIG. 1 is a perspective view of a drum type washing machine according to a related art.
Figure 2:
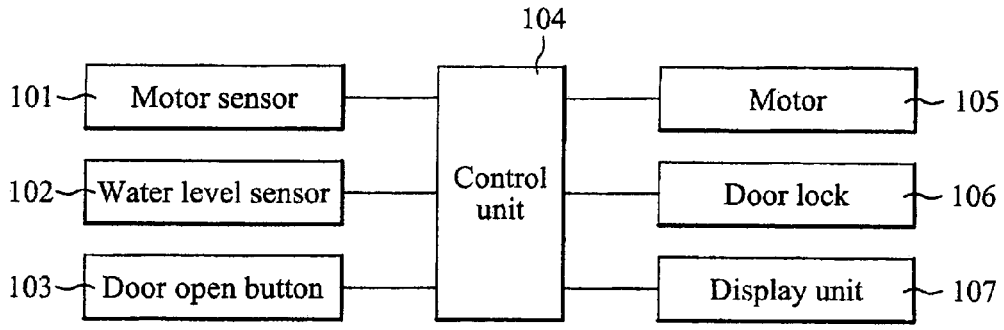
FIG. 2 is a block diagram of an apparatus for controlling a door of a drum type washing machine according to the present invention.

FIG. 2 is a block diagram of an apparatus for controlling a door of a drum type washing machine according to the present invention.

Referring to FIG. 2, an apparatus for controlling a door of a drum type washing machine according to the present invention includes a water level sensor 102 sensing a water level of water held in a washing tub, a motor sensor 101 sensing a revolution count of a motor 105 rotating the washing tub, a door open button 103 receiving a command of a user intending to open a door of the washing machine, a door lock 106 locking/unlocking the door, and a control unit 104 judging whether to open or close the door according to the water level in the washing tub and controlling the door lock 106 according to the judgment.

Moreover, the apparatus further includes a display unit 107 displaying the water level in the washing tub and whether to open or close the door to the user and an alarming unit (not shown in the drawing) making an alarm sound in case that the control unit 104 judges not to open the door when a user's command is inputted to the control unit 104 through the door open button 103.

The control unit 104 compares the water level in the washing tub to a reference to judge whether to open the door. In this case, if the water level in the washing tub is higher than the reference, the control unit judges that it is impossible to open the door. If the water level in the washing tub is lower than the reference, the control unit judges that the door can be opened.

A method of controlling a door of a drum type washing machine according to the present invention is explained as follows.

First Embodiment

Figure 3:
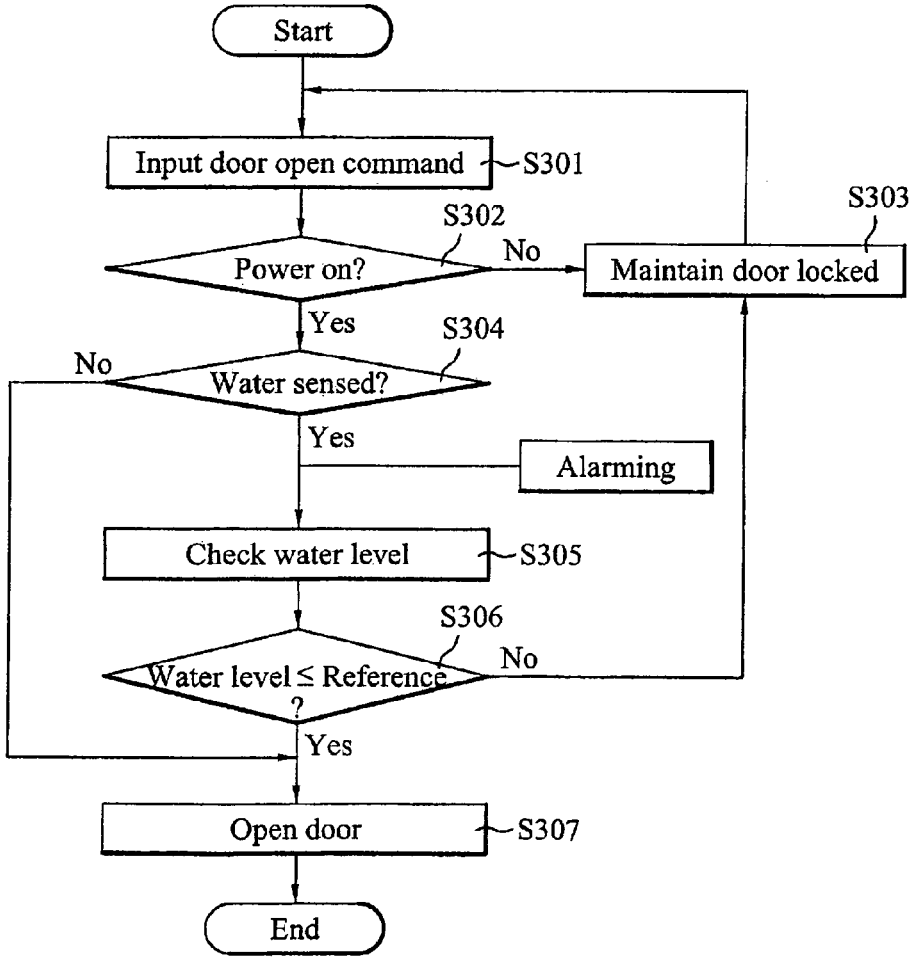
FIG. 3 is a flowchart of a method of controlling a door of a drum type washing machine according to a first embodiment of the present invention.

FIG. 3 is a flowchart of a method of controlling a door of a drum type washing machine according to a first embodiment of the present invention.

Referring to FIG. 3, once a user inputs a user's command for opening the door of the drum type washing machine to the control unit 104 through the door open button 103 (S301), the control unit 104 checks whether power of the washing machine is on or off (S302). While the power is not applied to the washing machine, the door is not opened by the door open button 103. Hence, the user intending to open the door should check whether the power is applied to the washing machine or not.

If the power is off, the control unit 104 locks the door or leaves the door locked when the door has been already locked (S303). If the power is on, the control unit 104 checks whether water is held in the washing tub using the water level sensor 102 (S304). If there exists no water in the washing tub, the control unit 104 unlocks the door to open since there is no possibility of flooding water (S307). If there exists water in the washing tub, the control unit 104 controls the water level sensor 102 to sense the corresponding water level (S305).

Thereafter, the control unit 104 compares the sensed water level to a reference set previously (S306). If the sensed water level is lower than the reference, the control unit 104 judges that the door can be opened and then unlocks the door to open (S307). In this case, in order not to flood the water in the tub outside, the reference is set as a height of the lowest end of the entrance of the laundry.

On the other hand, if the sensed water level is higher than the reference, the control unit 104 judges that it is impossible to open the door and then locks the door using the door lock 106 (S303). If the door was already locked, the control unit 104 leaves the door locked.

Subsequently, the control unit 104 informs the user of the possibility of opening the door through the display unit 107. The display unit 107 enables to display the possibility of opening the door, the water level in the washing tub, and locked/unlocked status of the door. Besides, in case of being unable to open the door since the water level in the washing tub is high, an alarm sound generator (not shown in the drawing), an alarm light, or LED can be used for informing the user, who inputted the door open command, of the impossibility of opening the door.

Thus, in case of being unable to open the door since the water level in the washing tub is high, the user or control unit 104 directly operates such a function of the washing machine as draining and the like to discharge the water inside. The door is then released to be open.

Moreover, in case that the power of the washing machine is cut off due to blackout or the like when the washing machine operates, the water will flood out if the door is opened. Hence, the control unit 104 automatically locks the door using the door lock the moment the power of the washing machine is cut off.

In the present invention, the door lock 106 is automatically controlled by the control unit 104. Yet, in case that the door needs to be opened while the power of the washing machine is cut off, the door lock 106 can be manually operated by the user.

Second Embodiment

Figure 4:
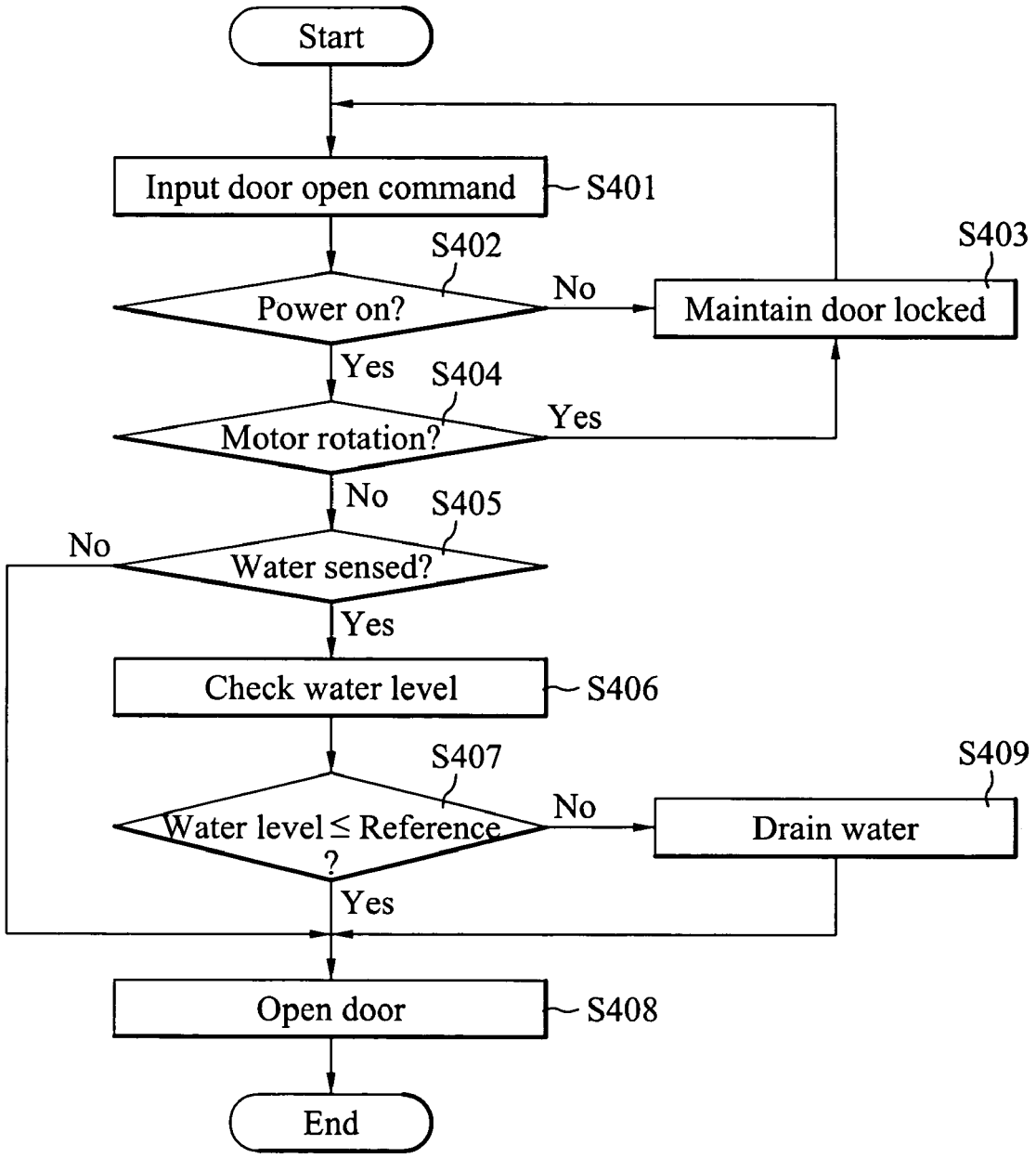
FIG. 4 is a flowchart of a method of controlling a door of a drum type washing machine according to a second embodiment of the present invention.

FIG. 4 is a flowchart of a method of controlling a door of a drum type washing machine according to a second embodiment of the present invention.

Referring to FIG. 4, once a user inputs a user's command for opening the door of the drum type washing machine to the control unit 104 through the door open button 103 (S401), the control unit 104 checks whether power of the washing machine is on or off (S402).

If the power is off, the control unit 104 locks the door or leaves the door locked when the door has been already locked (S403).

If the power is on, the control unit 104 checks whether the motor 105 is being driven or whether the washing tub rotates using the motor sensor 101 (S404).

If the motor 105 is being driven or if the washing tub rotates, the control unit 104 locks the door or leaves the door locked (S403). If the motor 105 is not being driven or if the washing tub fails to rotate, the control unit 104 checks whether water is held in the washing tub using the water level sensor 102 (S405).

If there exists no water in the washing tub, the control unit 104 unlocks the door to open since there is no possibility of flooding water (S408). If there exists water in the washing tub, the control unit 104 controls the water level sensor 102 to sense the corresponding water level (S406).

Thereafter, the control unit 104 compares the sensed water level to a reference set previously (S407). If the sensed water level is lower than the reference, the control unit 104 judges that the door can be opened and then unlocks the door to open (S408). In this case, in order not to flood the water in the tub outside, the reference is set as a height of the lowest end of the entrance of the laundry.

On the other hand, if the sensed water level is higher than the reference, the control unit 104 judges that it is impossible to open the door and then locks the door using the door lock 106 (S403).

Subsequently, the control unit 104 informs the user of the possibility of opening the door through the display unit 107. The display unit 107 enables to display the possibility of opening the door, the water level in the washing tub, and locked/unlocked status of the door. Besides, in case of being unable to open the door since the water level in the washing tub is high, an alarm sound generator (not shown in the drawing), an alarm light, or LED can be used for informing the user, who inputted the door open command, of the impossibility of opening the door.

Thus, in case of being unable to open the door since the water level in the washing tub is high, the user or control unit 104 directly operates such a function of the washing machine as draining and the like to discharge the water inside (S409). The door is then unlocked to be opened (S408).

Moreover, in case that the door which is locked needs to be opened, the presents invention enables a user to open the door manually using a manual switch (not shown in the drawing).

Accordingly, an apparatus for controlling a door of a drum type washing machine and method thereof according to the present invention allows the door to be opened only if there exists no water in the washing tub or if the water level in the tub is very low, by which water is prevented from cascading out of the washing machine when a door is opened. Therefore, the present invention enables to avoid the inconvenience caused to the user.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A method of controlling a door of a drum type washing machine, the washing machine including a cabinet having the door on a front vertical surface thereof and the washing tub positioned within the cabinet with an opening thereof corresponding to the door, the method comprising:

sensing a water level in a washing tub using a sensor coupled to the washing tub;

comparing in a controller of the washing machine the sensed water level to a reference water level previously stored in the controller; and locking or unlocking the door based on a result of the comparison between the sensed water level and the reference water level.

2. The method as claimed in claim 1, wherein locking or unlocking the door comprises locking the door when the sensed water level is higher than the reference water level, and unlocking the door when the sensed water level is lower than the reference water level.

3. The method as claimed in claim 1, further comprising displaying a lock/unlock status of the door on a display portion of the washing machine.

4. The method as claimed in claim 1, further comprising determining whether power is applied to the washing machine using the controller and its operable coupling to a plurality of functional elements of the washing machine prior to sensing the water level in the tub.

5. The method as claimed in claim 4, wherein the door remains in a current state when the controller determines that power is not applied, and wherein the controller determines whether the washing tub is rotating when the controller determines that power is applied.

6. The method as claimed in claim 5, further comprising maintaining a locked state of the door when it is determined that the washing tub is rotating, and performing the sensing step when it is determined that the washing tub is not rotating.

7. The method as claimed in claim 4, wherein the door remains in a current state when the controller determines that power is not applied, and wherein the controller performs the sensing step when the controller determines that power is applied.

8. The method as claimed in claim 1, wherein the reference water level is a level which is above a bottom of the washing tub and less than or equal to a bottom of the door.

9. The method as claimed in claim 1, wherein the reference water level is a level which is above a bottom of the washing tub and less than or equal to a lower peripheral edge of the door.

10. A method of controlling a door of a drum type washing machine, the washing machine including a cabinet having the door on a front vertical surface thereof and the washing tub positioned within the cabinet with an opening thereof corresponding to the door, the method comprising:

receiving, in a controller which is operably coupled to a plurality of functional elements of the washing machine, a command to open the door;

determining whether power is applied to the washing machine using the controller and its operable coupling to the plurality of functional elements;

determining whether water is present in a washing tub of the washing machine when the controller determines that power is applied using a water level sensor coupled to the controller;

unlocking the door when the controller determines that water is not present in the washing tub, and sensing a water level in the washing tub using the water level sensor operably coupled to the controller when the controller determines that water is present in the washing tub; and locking or unlocking the door based on the sensed water level.

11. The method as claimed in claim 10, wherein locking or unlocking the door comprises comparing, in the controller, the sensed water level to a reference water level previously stored in the controller to determine whether to lock or unlock the door.

12. The method as claimed in claim 11, further comprising locking the door when the controller determines that the sensed water level is higher than the reference water level, and unlocking the door when the controller determines that the sensed water level is lower than the reference water level.

13. The method as claimed in claim 11, further comprising draining water in the washing tub to less than the reference water level and thereafter unlocking the door when the controller determines that the sensed water level is higher than the reference water level.

14. The method as claimed in claim 11, wherein the reference water level is a level which is above a bottom of the washing tub and less than or equal to a bottom of the door.

15. The method as claimed in claim 10, further comprising displaying a lock/unlock status of the door on a display portion of the washing machine.

16. The method as claimed in claim 15, further comprising locking the door when the controller determines that the washing tub is rotating, and sensing the water level in the washing tub using the water level sensor when the controller determines that the washing tub is not rotating.

17. The method as claimed in claim 10, further comprising determining whether the washing tub is rotating using a motor sensor operably coupled to the controller when the controller determines that power is applied.

18. The method as claimed in claim 10, wherein the door remains in a current state if the controller determines that power is not applied to the washing machine.

* * * * *